United States Patent [19]

Beck et al.

[11] Patent Number: 4,967,457

[45] Date of Patent: Nov. 6, 1990

[54] ARRANGEMENT FOR STRETCHING THERMOPLASTIC FIBERS

[75] Inventors: Arnold Beck, Neumünster; Gerald Börst, Kiel; Dieter Ahrendt; Herbert Peters, both of Neumünster, all of Fed. Rep. of Germany

[73] Assignee: Neumüstersche Maschinen-Und Apparatebau GmbH (Neumag), Neumünster, Fed. Rep. of Germany

[21] Appl. No.: 439,535

[22] Filed: Nov. 20, 1989

[30] Foreign Application Priority Data

Dec. 2, 1988 [DE] Fed. Rep. of Germany ..... 3840602

[51] Int. Cl.[5] ..... D02J 1/22

[52] U.S. Cl. ..... 28/244

[58] Field of Search ..... 28/240, 241, 244

[56] References Cited

U.S. PATENT DOCUMENTS

| | | | |
|---|---|---|---|
| 3,124,631 | 3/1964 | Davis et al. | 264/289.6 |
| 3,897,916 | 8/1975 | Rosen | 242/152.1 X |
| 3,978,192 | 8/1976 | Sussman | 264/290.5 |
| 4,095,318 | 6/1978 | Abbott et al. | 28/241 |
| 4,327,873 | 5/1982 | Juppet et al. | 242/45 |
| 4,543,697 | 10/1985 | Phillips | 28/246 |
| 4,610,060 | 9/1986 | Phillips et al. | 28/246 |

FOREIGN PATENT DOCUMENTS

| | | |
|---|---|---|
| 1950743 | of 0000 | Fed. Rep. of Germany . |
| 2534546 | of 0000 | Fed. Rep. of Germany . |
| 3540181 | of 0000 | Fed. Rep. of Germany . |
| 284352 | of 0000 | Switzerland . |

OTHER PUBLICATIONS

Chemiefasern/Textilindustrie, Sep. 1981, pp. 638–648, Dr. K. Riggert, Verstreckung Von Polyester-Fadenkabel.

*Primary Examiner*—Werner H. Schroeder
*Assistant Examiner*—Bradley Kurtz DeSandro
*Attorney, Agent, or Firm*—Michael J. Striker

[57] ABSTRACT

An arrangement for stretching thermoplastic fibers of synthetic polymers, particularly polypropylene, polyester or polyamide, for producing high strength yarns, comprises a delivery mechanism for delivering fibers, a stretching mechanism for stretching fibers, and a plurality of heated rollers arranged between the delivery mechanism and the stretching mechanism for deviating the fibers and means for applying to the fibers a force which is opposite to a direction of movement of the fibers, none of the rollers being driven and at least one of said rollers is provided with a brake, the fibers passing around the rollers without slippage.

10 Claims, 2 Drawing Sheets

ARRANGEMENT FOR STRETCHING THERMOPLASTIC FIBERS

BACKGROUND OF THE INVENTION

The present invention relates to an arrangement for stretching thermoplastic fibers of synthetic polymers, especially polypropylene, polyester or polyamide, for producing high strength yarns.

It is known that for obtaining the desired mechanical properties of synthetic fibers, a stretching is required. The optimal stretching must be performed with as high as possible stretching ratio in a narrowly limited temperature interval. By the stretching, energy is supplied to the fibers. The magnitude of the energy depends on the stretching ratio and the stretching force. The fibers are heated due to the supplied energy. The stretching ratio must be limited to a value at which the heating produces no temperature increase which can lead to a reduction of the strength of the fibers and thereby to fiber breakage.

For providing higher stretching ratios, stretching arrangements have been developed in which the fibers passes several successive stretching zones. In the stretching zone which is adjacent to the stretching mechanism the stretching force acting in the fiber reaches its maximal value. In direction to the delivery mechanism, or in other words in direction which is opposite to the fiber running direction, the stretching force reduces in a stepped manner. Thus, the stretching is performed, with the exception of the last stretching zone, with reducing stretching force. Thereby with the same stretching ratio, less energy is introduced. This means that the higher stretching ratios are possible without tearing off the fibers.

In the German document DE-AS 1,950,743 additional rollers are arranged between the delivery mechanism and the stretching mechanism. They act as separating members between the successive stretching zones. Each roller is provided with a drive and has a peripheral speed at which a slippage is produced between the roller and the fiber. When the peripheral speed of the roller is slower than the fiber speed at the contact point or when it is opposite to the fiber speed, the friction force acts between the roller and the fiber so as to reduce the stretching force. In other words, the stretching force upstream of the roller is smaller than downstream of the same. The value of the stretching force depends on the relative speed between the fiber and the roller and on the surface property of the roller. The roller can serve as a heating or cooling element as well. In this known arrangement it is very difficult to adjust the desired sliding friction force and to maintain it permanently during the operation. A disadvantage of this arrangement is that during the sliding friction the fiber is loaded mechanically. A further disadvantage is the unavoidable friction heat which leads to a temperature increase and to reduction of the strength of the fiber.

The German document DE-OS 3,540,181 discloses a stretching arrangement in a heated water bath with three axes-parallel deviating bars which preferably are not rotatable. The fibers surround the deviating bars at alternating sides in a zig-zag shape. Due to the grouped support of the bars, the number of the effective deviating bars and the angle of wrap can be changed. In this manner, the number of the stretching zones and the stepping of the stretching force is varied. In this arrangement also it is difficult to maintain the sliding friction force permanent in the operation. A disadvantage of this arrangement is also that the available temperature region is limited here by the dew point of water.

U.S. Pat. No. 3,978,192 describes a stretching arrangement with three rotatable rotation bodies arranged at short distances near one another and formed as deviating elements. They also can be heated. The axes of the rotation elements can be slightly inclined relative to one another. At least one of both rotation element is conical while the increase of its radius is performed in the axial direction in form of small steps. The second rotation element can also be conical, and also it can be composed of a series of rollers which are located near one another and loosely sit on an axle. The fiber surrounds both rotation elements in several helical-like convolutions and moves in direction of the increased radius of the cone. The fiber lies without slippage on the conical surface and is stretched at each revolution to a predetermined value corresponding to the increase of the radius. Therefore, a uniform stepped stretching without the sliding friction is insured. What is not insured, however, is an optimal stepping of the stretching force.

The Swiss Pat. No. 284,352 describes a stretching arrangement with at least one deviating element located between the delivery mechanism and the stretching mechanism and formed for example as a heated roller so as to deviate the fiber by at least 90° from the straight line. Due to the deviation the structure of the treatment product is loosened so that the flow takes place immediately afterwards. In this manner it must be ensured that the stretching is performed always at the same place, namely on the deviating element. A subdivision of the stretching process into several stretching zones with different stretching force is not provided and cannot provided in this arrangement.

SUMMARY OF THE INVENTION

Accordingly, it is an object of the present invention to provide an arrangement for stretching thermoplastic fibers of synthetic polymers which avoids the disadvantages of the prior art.

More particularly, it is an object of the present invention to provide an arrangement of the above mentioned type in which, while avoiding sliding friction, an exact stepping of the stretching force along the fiber path between the delivery mechanism and the stretching mechanism can be obtained with high stretching ratio.

In keeping with these objects and with others which will become apparent hereinafter, one feature of the present invention resides, briefly stated, in an arrangement for stretching thermoplastic fibers of synthetic polymers, particularly of polypropylene, polyester or polyamide for producing high strength yarns, which has a delivery mechanism, a stretching mechanism, a plurality of heated rollers arranged between these mechanism for deviating the fiber and applying to the fiber a force opposite to a fiber movement, wherein the rollers are not driven but are provided with a brake.

In contrast to the arrangement disclosed in the above mentioned German reference DE-AS 1,950,743, the braking is here achieved not by the sliding friction (i.e. Kenatic friction) between the thread and the roller, but instead the fiber is held by adhesive slippage-free friction (i.e., static friction) on a roller engaging with the brake. Thereby the disadvantages of the sliding friction are eliminated. A great advantage of the invention is that the braking force is exactly adjustable and, when compared with the sliding friction between the thread and the roller, is variable in a considerably wider region. From above it is limited by the requirement that no slippage must take place between the fiber and the roller.

In accordance with a further feature of the present invention three or six rollers can be provided with the brakes. This insures a multi-stage reduction of the stretching force, and the provision of the six rollers is preferable.

Still another feature of the present invention is that there are additional non-braked rollers in the inventive arrangement. The additional non-braked rollers provide for the possibility of influencing the fiber temperature inside the individual stretching zones. The rollers can be arranged so that a non-braked roller can be located between two rollers provided with brakes.

At least one roller provided with the brake can be coupled with at least another roller, and the roller arranged downstream can have the same or almost insignificantly higher surface speed than that of the other roller. In this case the fiber passes between two rollers through a zone without elongation.

The rollers can have parallel axes or can be arranged in a zig-zag manner. This provides for a simplicity and good accessibility of the individual rollers.

The arrangement can be provided with two axles inclined relative to one another and carrying at least two rollers on each of them. Such arrangement is especially space economical.

The brake can be formed as an eddy current-hysteresis or as a fluid whirl brake. Also, the rollers can be provided with any suitable brakes.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
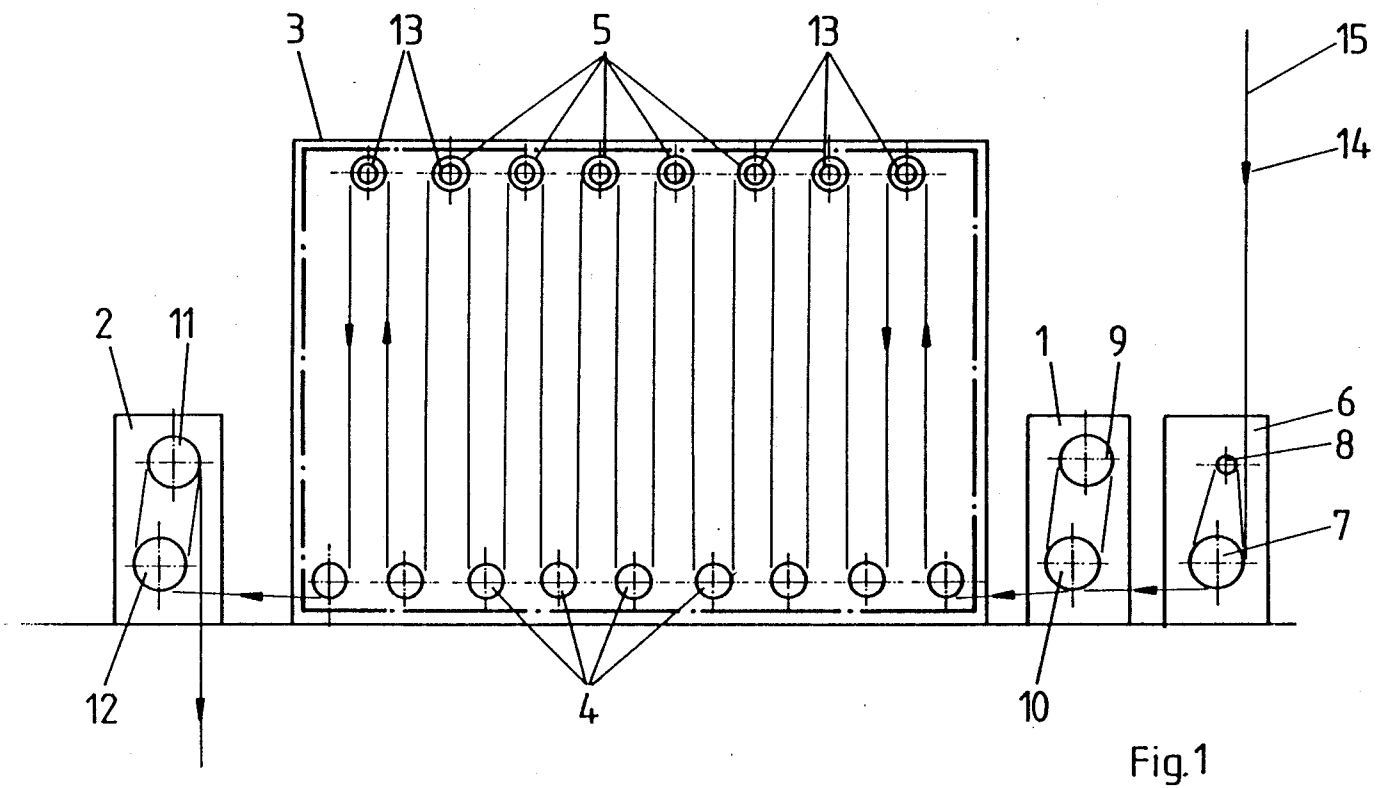
FIG. 1 is a front view of an arrangement for stretching fibers of synthetic polymers in accordance with the present invention.

The arrangement shown in FIG. 1 includes a delivery mechanism and a stretching mechanism 2, as well as a plurality of several non-driven independently rotatable rollers 4 and 5 arranged in a housing 3. The housing 3 is filled with air, steam or another gaseous medium. An inlet double unit 6 is provided before the delivery mechanism 1 and includes an inlet roller 7 and a separating roller 8. The delivery mechanism 1 and the stretching mechanism 2 are each composed of two substantially axes-parallel rollers 9, 10 and 11, 12. The delivery mechanism 1 and the stretching mechanism 2 are coupled with a not shown drive. The drive operates for maintaining a constant ratio of the number of revolutions, in accordance with which the peripheral speed of the rollers 11, 12 of the stretching mechanism 2 corresponding to the desired stretching ratio is higher than the peripheral speed of the rollers 9, 10 of the delivery mechanism 1.

The rollers 4 are arranged near the bottom of the housing 3 so that their axes lie parallel to one another in a horizontal plane. The axial distance between the neighboring rollers 4 is substantially equal to the double diameter of the rollers. The rollers 5 are correspondingly arranged near the top of the housing 3. They are offset relative to the rollers 4 by respective distances so that the connecting line of the axes of all rollers 4 and 5 have a zig-zag shaped course. The rollers 4 and 5 are heated. Each roller can be provided for example with an individual heating device in its interior in a conventional manner. The rollers can be also heated indirectly so that a heated gas passes through the interior of the housing 3 or the housing 3 is provided with not shown heating members.

The rollers 4 can be supported in a low friction manner for example by roller bearings. The rollers 5 can also be supported in a friction-free manner and moreover each provided with a brake 13. Suitable brakes in this case can be for example eddy current-hysteresis brakes or fluid whirl brakes available on the market with an adjustable braking moment.

A fiber 15 supplied in direction of the arrow 14 surrounds the inlet double unit 6 in several convolutions and then the heating rollers 9 and 10 of the delivery mechanism 1. Then it runs over the zig-zag shaped path without slippage around the rollers 4, 5 which accept a peripheral speed corresponding to the speed of the fibers. The angle of wrap of the individual rollers 4, 5 amounts in the above described example of the rollers to 180°, with the exception to the rollers located immediately near the delivery mechanism 1 and the drawing mechanism 2. At these both rollers the angle of wrap amounts to 90°. After leaving the housing 3, the fiber is supplied to the stretching mechanism 2. The angle of wrap of the rollers 11, 12 is substantially higher, for example from four to eight times higher than at the rollers 9, 10. Thereby a stretching force is produced in the fiber between the delivery mechanism 1 and the stretching mechanism 2, and it reaches its highest value at the running-in of the stretching mechanism 2. The stretching force is reduced in a stepped manner by the rollers 5 provided with the brakes, in direction of the movement of the fiber. The output of the delivery mechanism 1 is substantially lower than the maximum stretching force. The ratio of the maximal to minimal stretching force lies at least at 1–2, preferably 6–10 or even higher. The maximal stretching force amounts for example to 3–3.5 cN/dtex, while the minimal stretching force amounts to 0.2–0.5 cN/dtex. The reduction of the stretching force can be achieved, depending on the adjustment of the braking moment, in uniform or non-uniform steps. It can be for example advantageous to provide greater steps at the side of the inlet than at the side of the outlet. The measurement and regulation of the stretching force can be performed for example with the help of not shown force measuring devices which advantageously can be mounted on the bearings of the non-braked rollers 4. The freely rotatable and non-braked rollers 4, due to their insignificantly small bearing friction, have insignificant influence upon the stretching force. They however contribute to holding the fiber temperature at the desired level, in that they withdraw excessive heat supplied to the fibers in form of mechanical work carried out during stretching.

The stretching is performed in several steps, whose relative values depend on the stepping of the stretching force. The total stretching corresponds to the speed ratio between the stretching mechanism 2 and the delivery mechanism 1.

Figure 2:
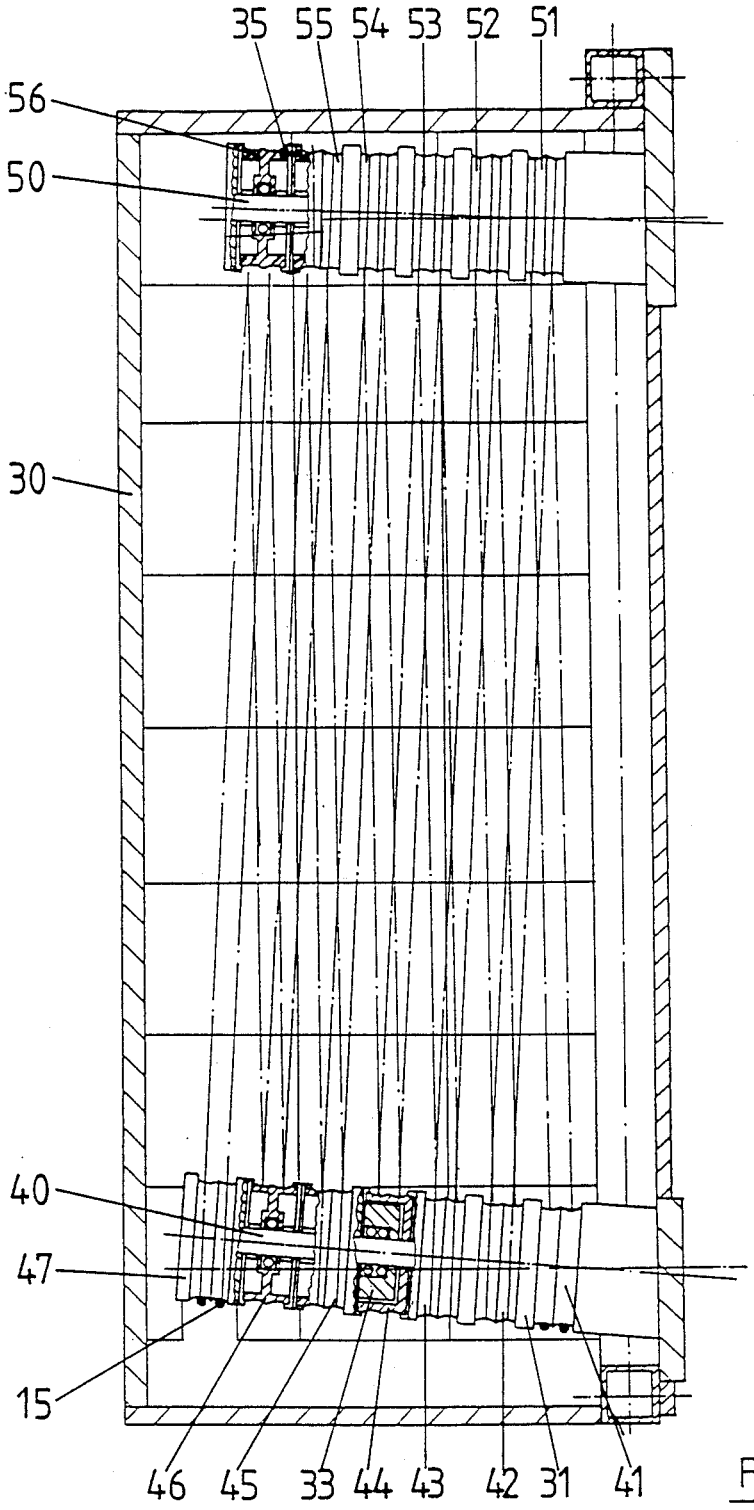
FIG. 2 is a side view, partially sectioned, of a part of another arrangement for stretching thermoplastic fibers in accordance with the present invention.

In the embodiment shown in FIG. 2, an axle 40 is mounted one-sidedly at the rear wall of a housing 30 close to the bottom. Rollers 41–47 are supported on the axle 40. Each rollers has two adjacently located peripheral flat ring grooves provided for two parallel running fibers on the outer surface. A small gap is produced between two facing end surfaces of each two neighboring rollers 41–47. It is covered on the periphery by a corresponding collar 31 which is mounted on one of the two neighboring rollers. A gap formed between the individual rollers 41–47 enables a free rotation of the rollers relative to one another. Some of the rollers 41–47 are provided with brakes 33 such as for example the roller 44 shown in section. Other rollers, such as for example the rollers 46 also shown in section are not braked.

Rollers 51–56 are similarly supported on an axle 50 which is located near the top of the housing but somewhat inclined relative to the axis 40. At least the roller 45 of these rollers is provided with a brake. The roller 55 is fixed with the neighboring roller 56 by a pin 35 for joint rotation therewith.

All rollers 41–47 and 51–57 are supported in a low-friction manner, they are not driven, with the exception of both rollers 55 and 56 and they are rotatable independently from one another.

Two threads 15 run from a delivery mechanism which is not shown in FIG. 2 to the roller 41 and surround the roller arrangement similarly to a double-thread screw in several convolutions. The angle of wrap of each roller amount to approximately 180°. The fibers run from roller 47 to a not shown stretching mechanism.

The operation of this device, with the exception of the different sequence in the braked and non-braked rollers along the fiber path, is analogous to the operation of the device of FIG. 1. The exception is that the fiber from the path of the roller 5 runs through the non-braked, freely-rotatable roller 46 to the roller 56 without elongation.

It will be understood that each of the elements described above, or two or more together, may also find a useful application in other types of constructions differing from the types described above.

While the invention has been illustrated and described as embodied in an arrangement for stretching thermoplastic fibers of synthetic polymers, particularly polypropylene, polyester or polyamide, for producing of high strength yarns, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. An arrangement for stretching thermoplastic fibers of synthetic polymers, particularly polypropylene, polyester or polyamide, for producing high strength yarns, the arrangement comprising a delivery mechanism for delivering fibers; a stretching mechanism for stretching fibers; and a plurality of heated rollers arranged between said delivery mechanism and said stretching mechanism for deviating the the fibers and means for applying to the fibers a force which is opposite to a direction of movement of the fibers, of said rollers being at least one of said rollers is provided with a said fibers pairing around said rollers without slippage.

2. An arrangement as defined in claim 1 wherein at least three rollers of said plurality of rollers are provided with said brakes.

3. An arrangement as defined in claim 1, wherein at least six rollers of said plurality of rollers are provided with said brakes.

4. An arrangement as defined in claim 1; and further comprising additional not-braked rollers.

5. An arrangement as defined in claim 1, wherein said plurality of rollers includes two rollers provided with said brakes and one roller arranged between said two rollers and not provided with such a brake.

6. An arrangement as defined in claim 1, wherein said plurality of rollers includes at least two rollers with one of said rollers provided with such a brake and another of said rollers not provided with such a brake and coupled with said first-mentioned one roller provided with such a brake, one of said two rollers being located downstream and having equal or at most insignificantly higher surface speed than the other of said two rollers.

7. An arrangement as defined in claim 1, wherein said rollers are arranged so that they have parallel axes and extend in a zig-zag path.

8. An arrangement as defined in claim 1; and further comprising two axles inclined relative to one another and each carrying at least two of said rollers.

9. An arrangement as defined in claim 1, wherein said brake is a eddy current-hysteresis brake

10. An arrangement as defined in claim 1, wherein said brake is a fluid whirl brake.

* * * * *